US009115485B2

(12) United States Patent
Kergoet et al.

(10) Patent No.: US 9,115,485 B2
(45) Date of Patent: Aug. 25, 2015

(54) TUB WITH SEPARATE COMPARTMENT WITH INTEGRATED WATER DISCHARGE SYSTEM

(71) Applicant: Kohler Co., Kohler, WI (US)

(72) Inventors: François Kergoet, Malakoff (FR); François Thommelin, Seligney (FR)

(73) Assignee: KOHLER CO., Kohler, WI (US)

( * ) Notice: Subject to any disclaimer, the term of this patent is extended or adjusted under 35 U.S.C. 154(b) by 379 days.

(21) Appl. No.: 13/781,304

(22) Filed: Feb. 28, 2013

(65) Prior Publication Data

US 2013/0227780 A1 Sep. 5, 2013

(30) Foreign Application Priority Data

Mar. 2, 2012 (FR) ..... 12 51936

(51) Int. Cl.
*E03C 1/00* (2006.01)
*E03C 1/22* (2006.01)
*E03C 1/186* (2006.01)

(52) U.S. Cl.
CPC . *E03C 1/22* (2013.01); *E03C 1/186* (2013.01); *E03C 1/00* (2013.01)

(58) Field of Classification Search
CPC ..... E03C 1/2302
USPC ..... 4/619–660
See application file for complete search history.

(56) References Cited

FOREIGN PATENT DOCUMENTS

| | | | |
|---|---|---|---|
| CN | 2630333 | Y | 8/2004 |
| CN | 2804192 | Y | 8/2006 |
| CN | 102162552 | A | 8/2011 |
| CN | 202117129 | U | 1/2012 |
| FR | 2712165 | | 5/1995 |
| GB | 20459 | | 0/1901 |
| GB | 190020459 | A | 0/1901 |
| GB | 20459 | | 10/1901 |
| GB | 348438 | | 5/1931 |

OTHER PUBLICATIONS

Preliminary Search Report dated Jan. 9, 2013 re FR1251936 (6 pages).
EP Notice of Allowance regarding Application No. 13157509.4.
Notification of First Office Action for Chinese Application No. 201310065895.2 mailed Mar. 10, 2014 (5 pages).
Extended European Search Report dated Jul. 10, 2013 in EP Application No. 13157509.4-1608.

*Primary Examiner* — Lori Baker
(74) *Attorney, Agent, or Firm* — Foley & Lardner LLP

(57) ABSTRACT

A tub includes a receptacle suitable for containing water. The tub also includes a compartment communicating with a discharge orifice of the tub and including an opening emerging in one face of the tub. The tub also includes a communication orifice suitable for the passage of water from the receptacle to the compartment, the compartment housing a water discharge system. A control plate forms a cover in the opening of the compartment and is configured for actuating the opening and closing of the water discharge system, the control plate being flush with the surface of the face of the tub when the discharge system is in the open position.

26 Claims, 3 Drawing Sheets

TUB WITH SEPARATE COMPARTMENT WITH INTEGRATED WATER DISCHARGE SYSTEM

CROSS-REFERENCE TO RELATED PATENT APPLICATIONS

The present application claims priority to and the benefit of French Patent Application No. 1251936, filed Mar. 2, 2012, the entire disclosure of which is incorporated herein by reference.

BACKGROUND

The present application relates to a container or tub, such as a washbasin or sink.

A tub, such as a traditional washbasin, includes a water discharge system suitable for controlling the passage of water from the receptacle of the tub to the discharge orifice. Traditionally, a water discharge system includes a plug emerging in the discharge orifice of the tub and cooperating with a valve that is movable relative to plug, thereby making it possible to open and close the water discharge system.

Furthermore, the water discharge system includes an overflow system making it possible to discharge excess water in the receptacle when the valve of the plug is in the closed position and the water supply is not stopped.

Document GB 1900 20459 describes a tub including a receptacle suitable for containing water and a separate compartment communicating by a communication orifice with the receptacle. The compartment communicates with a water discharge orifice and houses a water discharge system.

The water in the receptacle is thus discharged through said water discharge system toward an outside flow.

More specifically, the discharge system described in document GB 1900 20459 includes an overflow tube whereof a first end cooperates with the plug. The tube is actuated in a to-and-fro manner by an actuating rod situated on the second end of the overflow tube. This rod protrudes relative to the tub, above the compartment housing the overflow tube, creating an area on the tub that is difficult to clean.

A tub including surfaces that are easy to clean is proposed hereafter.

SUMMARY

According to an exemplary embodiment, a tub includes a receptacle suitable for containing water. The tub also includes a compartment communicating with a discharge orifice of the tub and including an opening emerging in one face of the tub. The tub also includes a communication orifice suitable for the passage of water from the receptacle to the compartment, the compartment housing a water discharge system. A control plate forms a cover in the opening of the compartment and is configured for actuating the opening and closing of the water discharge system, the control plate being flush with the surface of the face of the tub when the discharge system is in the open position.

According to another exemplary embodiment, a sink includes a basin configured to contain water. The sink also includes a compartment that is in fluid communication with a discharge orifice of the sink and that includes an opening emerging in an upper surface of the sink. The sink also includes a communication orifice configured to allow the passage of water from the basin to the compartment. The sink further includes a water discharge system located within the compartment and a control plate forming a cover for the opening of the compartment and configured to actuate the opening and closing of the water discharge system. The control plate is flush with the upper surface of the sink when the discharge system is in the open position.

DETAILED DESCRIPTION

Figure 1:
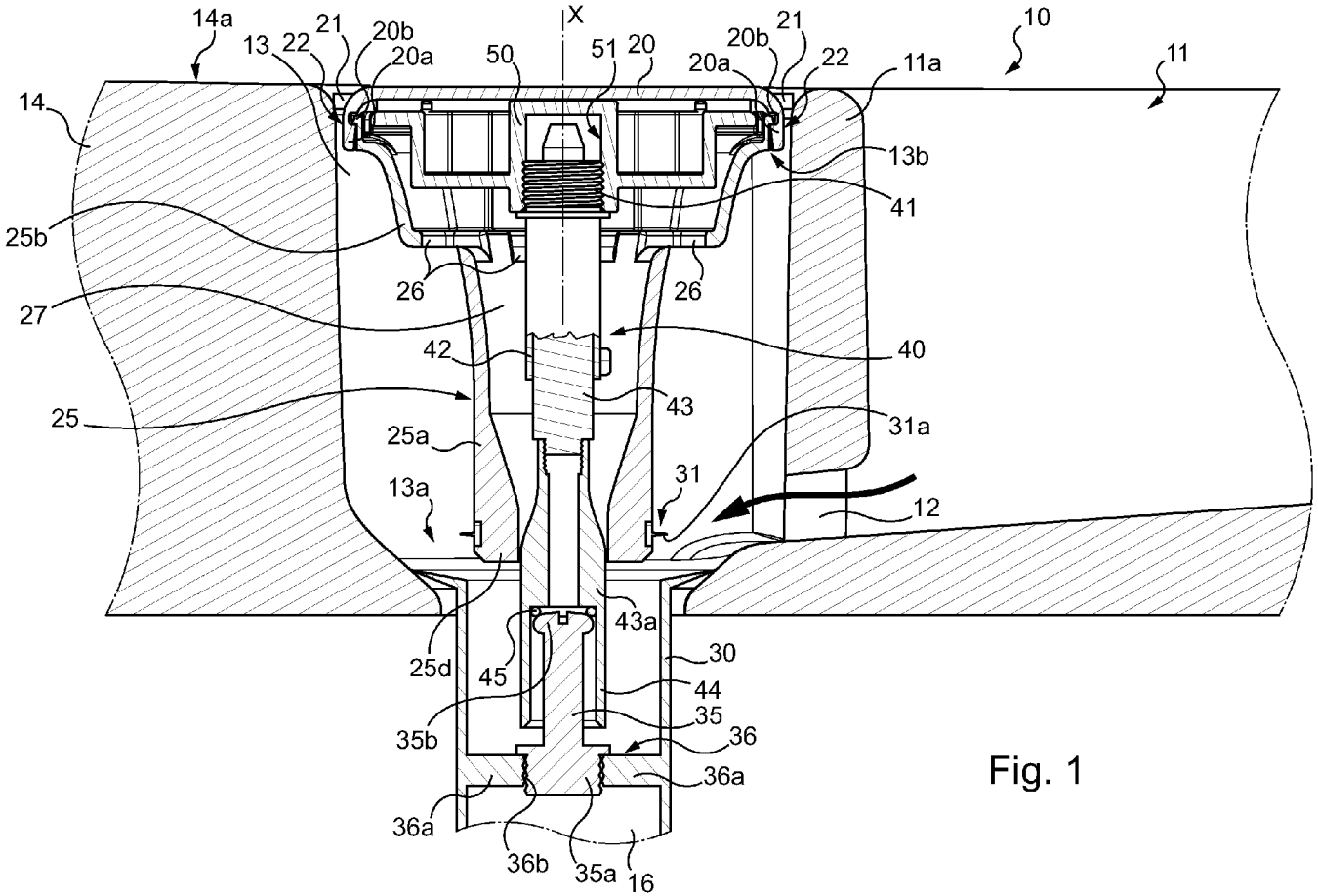
FIG. 1 is a cross-sectional view of a tub according to an exemplary embodiment, with the water discharge system being in the open position.

With reference to the accompanying figures, and according to an exemplary embodiment, a tub or sink 10 includes a receptacle or basin 11 suitable for containing water, a compartment 13 communicating with a discharge orifice 16 of the tub 10, and a communication orifice 12 suitable for the passage of water from the receptacle 11 to said compartment 13. The compartment 13 houses a water discharge system. The compartment 13 includes an opening 13*b* emerging in one face 14*a* of the tub 10, a control plate 20 forming a cover in said opening 13*b* of the compartment 13 and suitable for actuating the opening and closing of the water discharge system. The control plate 20 is flush with the surface of the face 14*a* of the tub 10 when the discharge system is in the open position.

According to an exemplary embodiment, a tub includes a receptacle suitable for containing water, a compartment communicating with a discharge orifice of the tub, and a communication orifice suitable for the passage of water from the receptacle to said compartment, the compartment housing a water discharge system.

The compartment includes an opening emerging in one face of the tub, a control plate forming a cover in said opening of the compartment and suitable for actuating the opening and closing of the water discharge system, said control plate being flush with the surface of said face of the tub when the discharge system is in the open position.

Thus, the cover of the opening of the compartment constitutes an actuating mechanism of the discharge system and does not protrude relative to the surface of the face of the tub in which it is integrated. Consequently, the face of the tub including the cover forms a smooth surface, which can be cleaned easily despite the incorporation of the actuating mechanism of the discharge system.

The discharge system and its actuating mechanism are thus concealed in the compartment, allowing a refined design of the tub.

Furthermore, the user can act on the control plate to open or close the water discharge system without getting his hands wet.

According to one embodiment, the control plate is incorporated into an upper face of the tub. Despite the presence of the actuating mechanism of the water discharge system, this upper face constitutes a surface capable of receiving different accessories or products useful during the use of the tub (soap, toothbrush mug, sponge, etc.).

According to one embodiment, water flow orifices emerging in said compartment are provided between the control plate forming the cover and said opening of the compartment.

Thus, these flow means prevent water from stagnating on the control plate, in particular when soap or a sponge is placed on that plate.

Advantageously, the control plate also constitutes an accessory holder of the soap holder, toothbrush mug, or sponge holder type.

According to one embodiment, the water discharge system includes an overflow tube mounted on the control plate, where the control plate and the overflow tube are removably mounted inside the compartment.

Thus, owing to the removal of the control plate and the overflow tube, it is possible to access the water discharge system, so as to clean it, as well as to clean the control plate and the overflow tube.

According to one advantageous feature, the water discharge system includes a plug communicating with the discharge orifice of the tub, a valve vertically movable between an open position and a closed position of the plug, and an overflow tube extending between the valve and the control plate.

Advantageously, the valve is moved between the open position and the closed position of the plug under the effect of the force exerted on the control plate and transmitted to the overflow tube, the control plate being associated with a device suitable for alternatingly moving the overflow tube and the valve in the open position and closed position upon each push.

Thus, the valve can be actuated between the open position and the closed position of the water discharge system by simply pushing on the control plate.

According to another advantageous feature, the opening of the compartment emerges in a rear upper face of the tub. Thus, the entire discharge system is placed in the compartment, at the rear of the tub, and is therefore in large part concealed from the user's view.

Preferably, the compartment extends substantially vertically in the rear area of the tub, thereby freeing the space directly accessible under the tub as much as possible. It is thus possible to introduce a chair under the tub to favor accessibility for persons with reduced mobility. The space freed under the tub can also make it possible to place a drawer or storage furniture without constraint, where the siphon spillway is normally housed.

Other particularities and advantages of the invention will appear in the following description.

In reference to FIG. 1, we will now describe one example embodiment of a tub. This tub may be a washbasin or a sink tub, or a tub designed for any other household or professional use, including a water discharge system that may be open or closed.

As illustrated in FIG. 1, the tub 10 comprises a receptacle 11 capable of containing water. The receptacle 11 comprises a communication orifice 12 allowing the passage of the water from the receptacle 11 to a compartment 13 integrated into the tub 10.

Figure 3:
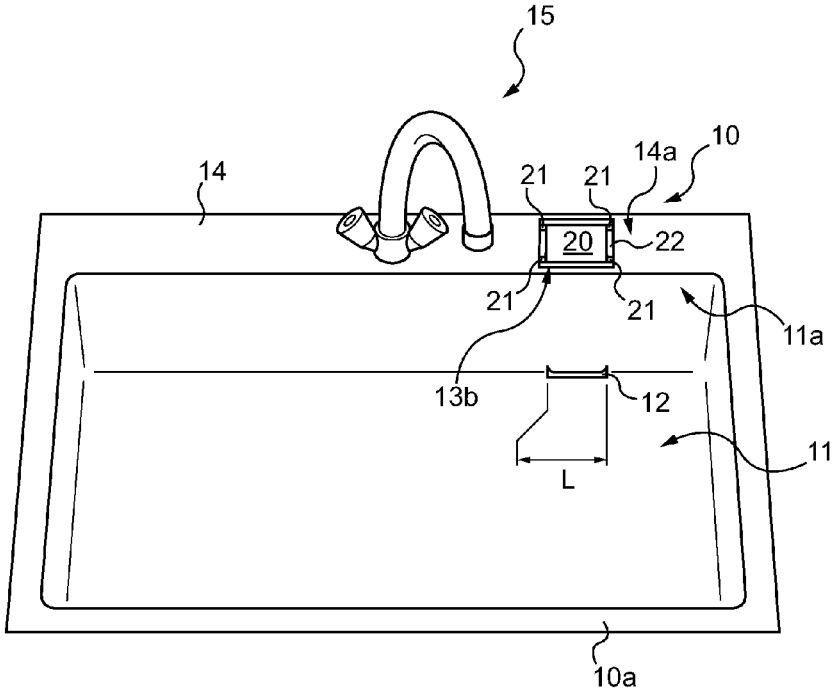
FIG. 3 is a simplified top view of a tub according to the exemplary embodiment shown in FIGS. 1 and 2.

In this example embodiment, and non-limitingly, the compartment 13 extends substantially vertically in a rear area 14 of the tub 10, i.e., in an area opposite a front edge 10*a* of the tub 10 in front of which the user is positioned (see FIG. 3). This rear area of the tub may for example traditionally correspond to the area where the valves and fittings 15 are mounted, as in particular illustrated in FIG. 3.

When the tub 10 is made from ceramic, the compartment 13 can be obtained directly by molding in the rear area 14 of the tub and can form a molded box inside the ceramic of the tub 10. The compartment 13 may have a substantially parallelepiped or cylindrical shape, with a vertical longitudinal axis X. Of course, the tub 10 and the compartment 13 can be made from another material, and for example from a synthetic material.

In the embodiment illustrated in FIG. 1, the communication orifice 12 comprises a slit arranged at the bottom of the receptacle 11, in a rear wall 11*a* of the receptacle 11. Here, this rear wall 11*a* of the receptacle 11 also constitutes a wall of the compartment 13 thus adjacent to the receptacle 11. The slit-shaped communication orifice 12 for example extends over a length L substantially corresponding to the width of the compartment 13, as illustrated in FIG. 3. This slit arranged in the bottom of the receptacle 11 is thus practically invisible to the user, improving the overall aesthetics of the tub and the receptacle 11.

According to one embodiment, the compartment 13 also communicates with a discharge orifice 16 of the tub 10. This discharge orifice 16 may be traditionally connected to a siphon (not shown) allowing an effective and odorless discharge of the wastewater outside the tub 10.

The compartment 13 in this example communicates with the discharge orifice 16 of the tub 10 at a lower end 13*a* of the compartment. On the other hand, this compartment 13 includes an opening 13*b* emerging in one face 14*a* of the tub 10.

In the embodiment illustrated in FIG. 1, this opening 13*b* emerges in an upper face of the tub 10 corresponding to the rear upper face 14*a* of the tub.

In order to allow the receptacle 11 to be filled with water or, on the contrary, to allow it to be emptied toward the discharge orifice 16, the compartment 13 houses a water discharge system that will be described in detail hereafter.

A control plate 20 is incorporated into the compartment 13 in order to actuate the opening and closing of the water discharge system. Of course, the control plate 20 and the compartment 13 may have any of a variety of configurations according to various exemplary embodiments.

As illustrated in FIG. 3, the opening 13*b* in this embodiment has a substantially rectangular or square shape in the plane of the rear upper face 14*a* of the tub 10.

As illustrated in FIGS. 1 and 3, the control plate 20 thus forms a cover at the opening 13*b* of the compartment 13. As a non-limiting example, the control plate 20 can be made from ceramic, or another material, like the entire tub 10.

As illustrated in FIG. 1, when the discharge system is in the open position, the control plate 20 extends in the opening 13*b* and is flush with the surface of the face 14*a* of the tub 10. Thus, the control plate 20 is incorporated into one face of the tub 10, in this example corresponding to the rear upper face 14*a* of the tub. The flushness of the control plate 20 makes it possible to obtain a substantially smooth rear upper face 14*a* of the tub without protruding elements (other than the valves and fittings 15), thereby facilitating its cleaning.

As illustrated in FIG. 3, the control plate 20 extends substantially in a plane and here has a rectangular or square shape, substantially complementary to the shape of the opening 13*b* of the compartment 13.

In order to facilitate its centering in the opening 13*b* of the compartment 13, this control plate 20 for example includes centering studs 21. The centering studs 21 are for example made from plastic. Furthermore, these centering studs 21 may be made from a deformable plastic to perform an anti-noise function in the contact area between the control plate 20 and the opening 13*b* of the compartment 13. Preferably, these centering studs 21 are arranged in the four corners of the control plate 20 if that plate is rectangular.

The control plate 20 is positioned in the opening 13*b* and centered using the centering studs 21 by forming an interstice 22 between the control plate 20 and the contour of the opening 13*b* of the compartment 13. The presence of the interstice 22 makes it possible to facilitate the manufacture of the tub, by creating an assembly allowance. Furthermore, the interstice 22 existing between the control plate 20 and the contour of the opening 13*b* of the compartment 13 can make up water flow orifices emerging in the compartment 13, making it possible to prevent water from stagnating at the control plate 20.

As an example, the control plate 20 may be adapted to serve as an accessory holder, and for example to act as a soap holder. In this respect, it will be noted that the upper face of the control plate 20 may optionally be structured to form a soap holder, and for example may include ribs or grooves for holding soap. According to another embodiment, the control plate 20 may also be suitable for supporting a toothbrush mug or acting as a sponge holder. Of course, these examples are provided non-limitingly and the control plate 20 may assume other configurations.

Furthermore, in order to facilitate the flow of water at the control plate 20, the latter may also include water passage orifices emerging directly in the compartment 13, under the control plate 20.

We will now describe the water discharge system incorporated into the compartment 13 previously described.

In principle, the water discharge system first includes an overflow tube 25 fastened to the control plate 20. In one embodiment, the overflow tube 25 comprises, along the vertical longitudinal direction X corresponding to the vertical longitudinal axis X of the compartment 13, longitudinal portions 25*a*, 25*b* with different transverse sections. Thus, the overflow tube 25 includes a first longitudinal portion 25*a* fastened to a second longitudinal portion 25*b* of the overflow tube 25, which in turn is fastened to the control plate 20.

The second longitudinal portion 25*b* has a transverse section with dimensions substantially equal to the dimensions of the control plate 20 to allow assembly of the overflow tube 25 on the control plate 20.

In this embodiment and non-limitingly, the control plate 20 includes a peripheral rim 20*a* extending toward the inside of the compartment 23 and including retaining elements 20*b* designed to cooperate by clipping with a peripheral end 25*c* of the second longitudinal portion 25*b* of the overflow tube 25.

The retaining elements 20*b* may include, as non-limiting examples, a peripheral groove provided on the peripheral rim 20*a* of the control plate 20.

The overflow tube 25 includes at least one water passage orifice 26 from the compartment 13 toward the inside 27 of the overflow tube 25.

In one embodiment and non-limitingly, the overflow tube 25 includes four water passage orifices 26 distributed equidistantly on the periphery of the overflow tube 25. Of course, a different number of water passage orifices 26 could be provided, as well as a different distribution of those water passage orifices 26.

In one embodiment, the water passage orifices 26 are situated at a junction area between the first longitudinal portion 25*a* and the second longitudinal portion 25*b* of the overflow tube 25.

Furthermore, the water discharge system includes a plug 30 in communication with the discharge orifice 16 of the tub. This plug 30 may be a commercially available plug normally equipping a discharge orifice of a tub 10.

This plug 30 is suitable for cooperating with a valve 31 vertically movable between the open position and the closed position of the plug 30.

In this embodiment, the valve 31 is fastened to the overflow tube 25. The overflow tube 25 thus extends between the valve 31 and the control plate 20. More specifically, the valve 31 is mounted on the overflow tube 25 at an end 25*d* opposite the end 25*c* secured to the control plate 20.

In this embodiment, and purely as an illustration, the valve 31 includes an outer seal 31*a* that is suitable for cooperating with the plug 30 in the closed position, i.e., fitting the inner contour of the plug to close the water passage. This outer seal 31*a* is mounted on the outer surface of the overflow tube 25.

In order to obtain the movement of the vertically movable valve 31 between the open position and the closed position of the plug 30, the overflow tube 25 is in turn mounted vertically movably in the compartment 13, along the vertical longitudinal axis X.

The movement of the valve 31 between the open position and a closed position of the plug 30 is done under the effect of a pressure force exerted on the control plate 20 and transmitted to the overflow tube 25 secured to that control plate.

The control plate 20 is associated with a device 40 suitable for alternatingly moving the overflow tube 25 and the valve 31 in the open position and in the closed position upon each pressing force or thrust exerted on the control plate 20. This alternating movement device 40 moving by means of pushing may be implemented by any known type of device implementing two slides mounted one in the other and movable between a retracted position and an idle position under the action of a spring. In particular, a device of this type implementing a cam is described in document FR 2,712,165. Reference may advantageously be made to this document for the detailed description of this vertical to-and-fro movement system under the action of a pressing force.

More specifically, in the embodiment illustrated in FIG. 1, the alternating movement device 40 is fastened, here by screwing at one end 41 thereof, at the control plate 20. To that end, the control plate 20 is fastened to an attached piece 50 including a threaded orifice 51 designed to be assembled by screwing the end 41 of the alternating movement device 40. As a non-limiting example, the attached piece 50 is pinched on the edges thereof between the control plate 20 and the second longitudinal portion 25*b* of the overflow tube 25. Alternatively, the piece 50 comprising the threaded orifice 51 may be made as a single piece with the control plate 20.

In principle, this alternating movement device 40 comprises two concentric tubes 42, 43 sliding one in the other. In this embodiment, a first tube 42 is secured to the end 41 fastened to the control plate 40. A second tube 43, sliding inside the first tube 42, extends in the extension of that first tube 42 and includes, at its opposite end 43*a*, abutment means against the plug 30.

In this particular embodiment and non-limitingly, the plug 30 comprises, in its center, a finger 35 extending in the vertical longitudinal direction X of the system. Thus, the center of the plug 30 includes means 36 for assembling the finger 35.

Here, the assembly means 36 are for example formed in the cylindrical body of the plug 30 by arms 36*a* (for example, four arms arranged at 90° intervals relative to one another) secured to a central threaded orifice 36*b* suitable for mounting one end 35*a* of the finger 35 by screwing. The finger 35 can thus be mounted by screwing at its end 35*a* bearing a screw pitch complementary to the central threaded orifice 36*b* of the plug 30.

The end 43*a* of the alternating movement device 40 comprises an extension sleeve 44 extending around said finger 35 and including a stop 45 against the finger 35. For example, the extension sleeve 44 covers one end 35*b*, opposite the end 35*a* screwed in the plug 30. The stop 45 may for example be a rubber O-ring serving to damp the forces related to the vertical movement of the alternating movement device 40.

Thus, the alternating movement device 40 is on the one hand secured to the control plate 20 and on the other hand is mounted abutting against the finger 35 secured to the plug 30.

Figure 2:
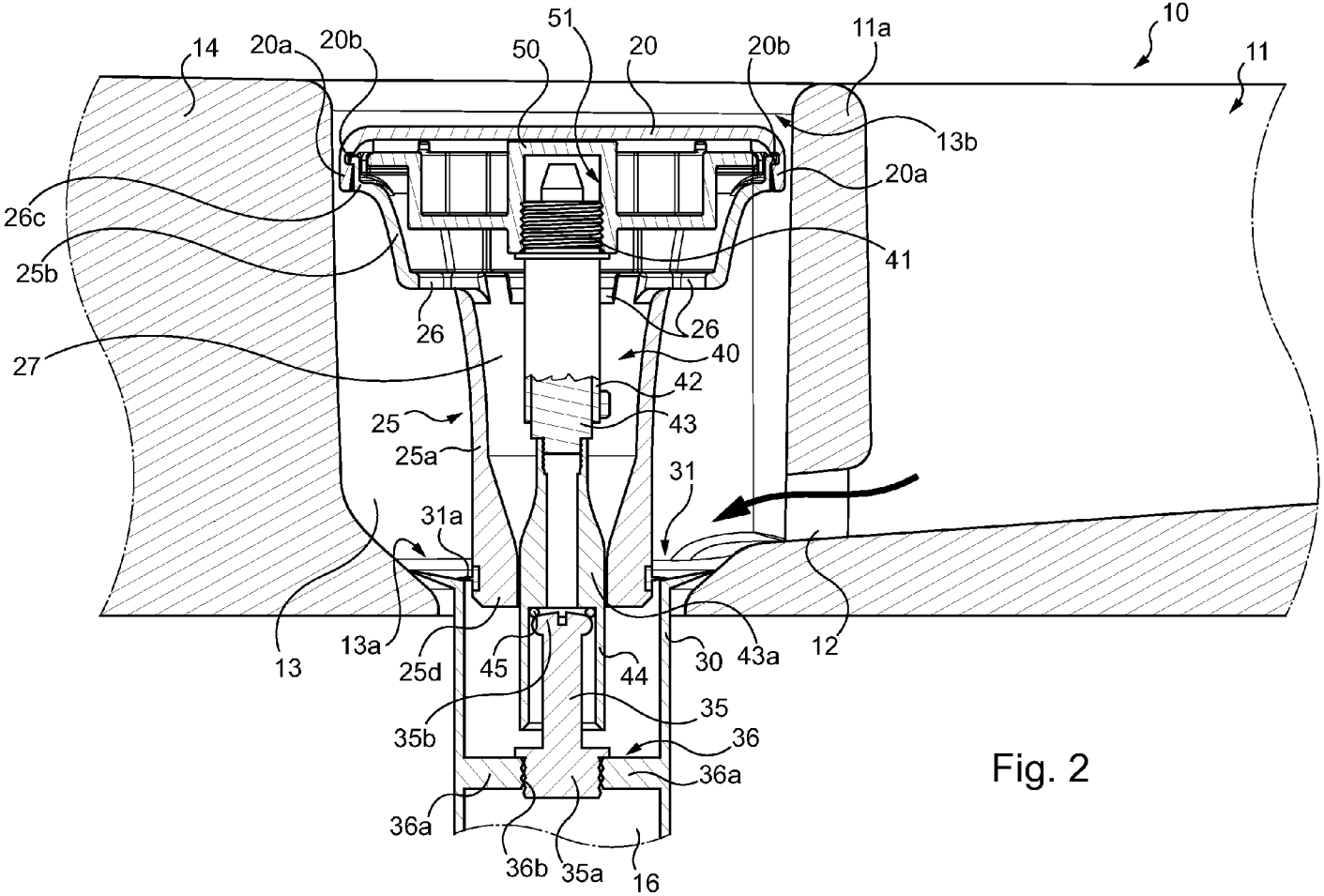
FIG. 2 is a view similar to FIG. 1, with the water discharge system being in the closed position.

Thus, as illustrated in FIG. 2, a pressing force exerted on the control plate 20 will tend to move the second tube 43 relative to the first tube 42 of the alternating movement device 40 and to position the latter in a first locking position in which the total length of the two tubes 42, 43 is decreased.

In this position, the control plate 20 as well as the overflow tube 25 are placed inside the compartment 13 and kept in a position pushed inside the compartment 13.

As illustrated in FIG. 2, this position allows movement of the overflow tube 25 and the valve 31 to the closed position of the plug 30.

It will be noted that the travel of the alternating movement device 40 must be sufficient to allow the valve 31 to move to the closed position of the plug 30.

A new pressing force exerted on the control plate 20 results in releasing the first locking position of the alternating movement device 40, such that the total length of the two tubes 42, 43 increases. In this position, the control plate 20 again occupies the extreme position as illustrated in FIG. 1, while being flush with the surface of the face 14*a* of the tub 10 bearing the opening 13*b*. Furthermore, as illustrated in FIG. 2, when the plug 30 is closed by the valve 31, the position of the overflow done at the overflow tube 25 is also adjusted. More specifically, the position of the water passage orifices 26 in the height of the overflow tube 25 must be determined as a function of the maximum desired water height in the receptacle 11 when the discharge system is in the closed position.

Thus, in the open position as illustrated in FIG. 1, the water introduced into the receptacle 11 flows freely through the communication orifice 12, then into the bottom of the compartment 13 up to the plug 30 toward the discharge orifice 16 of the tub.

In the closed position of the discharge system, as illustrated in FIG. 2, the water introduced into the tub fills the latter and at the same time, owing to the communication orifice 12, fills the part of the compartment 13 situated around the overflow tube 25.

If the height of the water reaches the passage orifices 26 of the overflow tube 25, the water flows through those passage orifices 26 to the inside of the overflow tube 25 and is discharged beyond the valve 31 directly at the plug 30 and the discharge orifice 16 of the tub 10.

In the example embodiment described in reference to FIG. 1, the control plate 20 and the overflow tube 25 are removably mounted inside the compartment 13. Thus, it is possible to remove the control plate 20 fastened to the overflow tube 25, also incorporating the alternating movement device 40, in a single piece. The device may be removed through brief pressure when the discharge system is in the closed position, allowing the assembly to rise to the inside of the compartment 13 and the user to grasp the assembly thus protruding above the rear upper face 14*a* of the tub 10, at the opening 13*b*. In fact, by using the finger to press on the control plate 20 in the closed position, without keeping the finger in contact with said control plate 20, the force of the spring integrated into the alternating movement device 40 causes the control plate to exit beyond the opening 13*b*, above the rear upper face 14*a* of the tub 10.

Alternatively, the same pushing action with the finger may result in causing the control plate 20 to exit above the rear upper face 14*a* of the tub, the control plate 20 then being kept above that rear upper face 14*a* by the centering studs 21 bearing on the edge of the opening 13*b*. The control plate 20 no longer being embedded in the opening 13*b*, it can be grasped by the user.

Another solution may also consist of providing sufficient play of the control plate 20 around the vertical longitudinal axis X of the compartment 13, making it possible, by pressing on one of the corners of the control plate 20, to obtain lifting of the opposite corner, allowing the user to grasp the assembly and remove it from the compartment 13.

Owing to the complete disassembly of the control plate 20 and the overflow tube 25, the cleaning of the system is facilitated, not only for said removable elements, but also for the compartment 13 and the plug 30 fastened at the discharge orifice 16. Thus, all of the parts of the tub likely to contain water in direct communication with the water of the receptacle 11 are accessible and can be cleaned easily. In particular, the dimensions of the compartment 13 must be sufficient to allow the passage of a user's hand for cleaning thereof.

Positioning the assembly of the discharge system at the rear of the tub 10, in the compartment 13, makes it possible to completely free the space under the receptacle 11 of the tub, thereby facilitating accessibility for people with reduced mobility or the use of that free space under the tub to position a piece of furniture or drawer.

Furthermore, the receptacle 11 may have a refined design, only the slit-shaped communication orifice 12 being visible to the user.

Of course, the configuration of the system is not limited to the example embodiment previously described. In particular, the position of the compartment 13 housing the discharge system may be different, and for example may be on the side of the receptacle, the opening 13*b* thus emerging on a lateral upper face of the tub 10. Furthermore, in the example embodiment previously described, the alternating movement device 40 is fastened to the overflow tube.

One alternative solution may consist of using a valve integrating such an alternating movement system, as in particular described in document FR 2,712,165, the control plate 40 and the overflow tube 25 being placed above that valve. In that case, a pressure force exerted on the control plate 20 is transmitted by means of the overflow tube 25 to the valve. The latter then alternatingly positions itself in an open position and a closed position of the plug owing to the alternating movement system integrated into the valve itself.

The terms "approximately," "about," "substantially" and "similar" are used here in the broad sense in line with their usage commonly allowed by those skilled in the art familiar with the field of this description. One skilled in the art will understand upon reading this description that these terms are used to allow a description of certain described and claimed features without restricting the scope of those features to precise numerical values. Consequently, these terms should be interpreted as indicating that the modifications or developments of the embodiments described and claimed are included in the scope of the invention as defined in the claims.

The terms "example" and "exemplary" are used to describe several embodiments and indicates that those embodiments are possible examples, depictions and/or illustrations of different embodiments (these terms are not used to indicate that certain embodiments are necessarily extraordinary or high-quality examples).

The terms "couple," "connect" and similar terms used here refer to the junction of two elements to each other directly or indirectly. This junction may be fixed (i.e., permanent) or movable (i.e., removable or detachable). This junction may be done with two elements where the two elements and any additional intermediate element are fully formed as a single unitary body, or with two elements where the two elements and any additional intermediate element are fastened to each other.

The references used regarding the position of the elements (for example, "upper," "lower," "above," "below," etc.) are simply used to describe the orientation of the various elements in the FIGURES. The orientation of these various elements may vary as a function of different embodiments, and the variation is included in the scope of the description.

The construction and arrangement of the different embodiments are purely illustrative. Although only some embodiments have been described in detail in the description, one skilled in the art will easily see, upon reading the description, the possible modifications (for example, variation of the sizes, dimensions, structures, shapes and proportions of the different elements, parameter values, assembly types, use of material, colors, orientations, etc.) that can be made without going beyond the scope of the description. For example, the elements illustrated having a single body may be built from multiple parts or elements, the position of the elements may be reversed or modified, and the nature and number of elementary elements or positions may be modified or altered. Other substitutions, modifications, changes and deletions may also be made to the operating conditions and the arrangement of the different embodiments without going beyond the scope of the description.

What is claimed is:

1. A tub including a receptacle suitable for containing water, the tub comprising:

a compartment communicating with a discharge orifice of the tub and including an opening emerging in one face of the tub;

a communication orifice suitable for the passage of water from the receptacle to the compartment, the compartment housing a water discharge system; and a control plate forming a cover in the opening of the compartment and configured for actuating the opening and closing of the water discharge system, the control plate being flush with the surface of the face of the tub when the discharge system is in the open position.

2. The tub of claim 1, wherein the control plate is incorporated into an upper face of the tub.

3. The tub of claim 1, further comprising water flow orifices emerging in the compartment that are provided between the control plate and the opening of the compartment.

4. The tub of claim 3, wherein the control plate also constitutes an accessory holder that is configured to act as at least one of a soap holder, toothbrush mug, or sponge holder.

5. The tub of claim 1, wherein the water discharge system includes an overflow tube mounted on the control plate, the control plate and the overflow tube being removably mounted inside the compartment.

6. The tub of claim 1, wherein the water discharge system includes a plug communicating with the discharge orifice of the tub, a valve vertically movable between an open position and a closed position of the plug, and an overflow tube extending between the valve and the control plate.

7. The tub of claim 6, wherein the valve is fastened to the overflow tube and the overflow tube is vertically movable in the compartment.

8. The tub of claim 7, wherein the valve includes an outer seal that is suitable for cooperating with the plug in the closed position and is mounted on an outer surface of the overflow tube.

9. The tub of claim 7, wherein the valve is configured for movement between the open position and the closed position of the plug under the effect of the pushing exerted on the control plate and transmitted to the overflow tube, the control plate being associated with a device suitable for alternatingly moving the overflow tube and the valve between the open position and closed position upon each push.

10. The tub of claim 5, wherein the overflow tube includes at least one water passage orifice from the compartment toward the inside of the overflow tube.

11. The tub of claim 1, wherein the opening of the compartment emerges in a rear upper face of the tub.

12. The tub of claim 1, wherein the control plate is formed of a ceramic material.

13. The tub of claim 1, wherein the compartment extends substantially vertically in the rear area of the tub.

14. The tub of claim 1, wherein the communication orifice comprises a slit arranged at the bottom of the receptacle, in a rear wall of the receptacle also forming a wall of the compartment.

15. A sink comprising a basin configured to contain water, the sink comprising:

a compartment in fluid communication with a discharge orifice of the sink and including an opening emerging in an upper surface of the sink;

a communication orifice configured to allow the passage of water from the basin to the compartment;

a water discharge system located within the compartment; and a control plate forming a cover for the opening of the compartment and configured to actuate the opening and closing of the water discharge system, wherein the control plate is flush with the upper surface of the sink when the discharge system is in the open position.

16. The sink of claim 15, further comprising a water flow orifice emerging in the compartment that is provided between the control plate and the opening of the compartment.

17. The sink of claim 16, wherein the control plate is configured to act as an accessory holder in the form of at least one of a soap holder, toothbrush mug, or sponge holder.

18. The sink of claim 15, wherein the water discharge system includes an overflow tube mounted on the control plate, wherein the control plate and the overflow tube are removably mounted inside the compartment.

19. The sink of claim 15, wherein the water discharge system includes a plug communicating with the discharge orifice of the sink, a valve vertically movable between an open position and a closed position of the plug, and an overflow tube extending between the valve and the control plate.

20. The sink of claim 19, wherein the valve is fastened to the overflow tube and the overflow tube is vertically movable in the compartment.

21. The sink of claim 20, wherein the valve includes an outer seal that is suitable for cooperating with the plug in the closed position and is mounted on an outer surface of the overflow tube.

22. The sink of claim 20, wherein the valve is configured for movement between the open position and the closed position of the plug in response to a force exerted on the control plate and transmitted to the overflow tube, and herein the control plate is associated with a device configured for alternatingly moving the overflow tube and the valve between the open position and the closed position upon each push of the control plate.

23. The sink of claim 18, wherein the overflow tube includes at least one water passage orifice from the compartment toward the inside of the overflow tube.

24. The sink of claim 15, wherein the opening of the compartment emerges in a rear upper face of the sink.

25. The sink of claim 15, wherein the compartment extends substantially vertically in the rear area of the sink.

26. The sink of claim 15, wherein the communication orifice comprises a slit arranged at the bottom of the basin, in a rear wall of the basin that also forms a wall of the compartment.

* * * * *